US006641380B1

(12) United States Patent
Nied-Menninger et al.

(10) Patent No.: US 6,641,380 B1
(45) Date of Patent: Nov. 4, 2003

(54) VANE PUMP HAVING A PRESSURE PLATE AND A SHAFT SEAL

(75) Inventors: Thomas Nied-Menninger, Nottuln (DE); Hans-Jürgen Lauth, Neu Anspach (DE)

(73) Assignee: Luk Fahzeug-Hydraulik GmbH & Co. KG (DE)

( * ) Notice: Subject to any disclaimer, the term of this patent is extended or adjusted under 35 U.S.C. 154(b) by 0 days.

(21) Appl. No.: 10/129,345

(22) PCT Filed: Oct. 28, 2000

(86) PCT No.: PCT/EP00/10639

§ 371 (c)(1), (2), (4) Date: Sep. 11, 2002

(87) PCT Pub. No.: WO01/33081

PCT Pub. Date: May 10, 2001

(30) Foreign Application Priority Data

Nov. 2, 1999 (DE) ..... 199 52 605

(51) Int. Cl.[7] ..... F04C 2/344

(52) U.S. Cl. ..... 418/104; 418/132; 418/133; 418/135

(58) Field of Search ..... 418/104, 132, 418/133, 135

(56) References Cited

U.S. PATENT DOCUMENTS 4,573,890 A * 3/1986 Hadama et al. ..... 418/133

4,818,189 A 4/1989 Nakajima ..... 417/295

FOREIGN PATENT DOCUMENTS

| | | |
|---|---|---|
| DE | 2907058 | 9/1979 |
| DE | 3303247 | 8/1983 |
| DE | 19725195 | 1/1998 |
| DE | 19900927 | 7/1999 |
| JP | 63-173893 | 7/1988 |
| JP | 6-058266 | 3/1994 |
| JP | 7-279871 | 10/1995 |

* cited by examiner

*Primary Examiner*—John J. Vrablik
(74) *Attorney, Agent, or Firm*—Ostrolenk, Faber, Gerb & Soffen, LLP

(57) ABSTRACT

A pump is proposed, in particular a vane pump, for a liquid or gaseous medium, which can be driven with the help of a motor, in particular an electric motor, and which comprises a rotor (15) that can be coupled to a drive shaft (29) of the motor and is arranged in an operating chamber and at least one pressure plate (25) that closes the operating chamber (11) in the axial direction and on its lateral face (27) facing away from the rotor (15) is connected to a pressure chamber (23), and also a coupling element (47; 47') which surrounds part of the drive shaft (29), cooperates with at least one seal and contributes to sealing off the pressure chamber (23) with respect to the motor, the drive shaft (29) extending through a through opening (35) in the pressure plate (25). The pump (1) is characterized in that the coupling element (47; 47') has a sleeve-like section (49) which engages in the through opening (35) in the pressure plate (25).

14 Claims, 2 Drawing Sheets

VANE PUMP HAVING A PRESSURE PLATE AND A SHAFT SEAL

The invention relates to a pump, in particular a vane pump, for a liquid or gaseous medium and particularly the sealing of the pressure chamber and the operating chamber of the pump.

Known pumps of this type are used, for example, for power steering systems in a motor vehicle. They comprise an operating chamber, which is closed in the axial direction by means of at least one pressure plate. Arranged in the operating chamber is a rotor, which can be coupled to the drive shaft of an electric motor. A separate mounting for the rotor is not provided, as the rotor is mounted exclusively via the drive shaft. This configuration, however, produces large external diameters for the at least one bearing of the drive shaft and a shaft sealing ring which seals off the electric motor with respect to the pump in the area of the drive shaft.

On the lateral face facing away from the rotor, the pressure plate is in contact with a pressure chamber, which is sealed off with respect to the motor by a coupling element that cooperates with at least one seal and surrounds part of the drive shaft. The coupling element engages over an annular flange on the pressure plate, which flange is provided on the side facing away from the rotor and has a greater external diameter. As a result, between the flange and the coupling element, a radially inner sealing face is formed which divides the pressure chamber from the pump unit and whose distance from the axis of rotation of the drive shaft is large. The arrangement of the inner sealing face also determines the distance between the pressure chamber and the axis of rotation of the drive shaft, which is accordingly very large. As a result, the external diameter of the rotating group has to be configured in a correspondingly large manner.

SUMMARY OF THE INVENTION

It is therefore an object of the invention to provide a pump of the type mentioned at the beginning in which a more compact design, in particular a pump unit with a small external diameter, can be implemented.

In order to achieve this object, a pump having the features of the invention is distinguished by the fact that the coupling element has a sleeve-like section which engages in the through opening in the pressure plate. The distance between a radially inner sealing face of the pressure chamber and the axis of rotation of the drive shaft between the coupling element and the through opening in the pressure plate is therefore only very small, so that a pump unit having the pressure plate and the rotor can be implemented with a small external diameter. As a result, a pump with a compact, space-saving construction can be provided.

According to a development of the invention, the diameter of the through opening made in the pressure plate is smaller, preferably considerably smaller, than the external diameter of a shaft sealing ring surrounding part of the drive shaft. Since the shaft sealing ring must not be connected to the pressure chamber, a radially outer sealing face of the pressure chamber is arranged at a great distance from the drive shaft, on account of the large external diameter of the shaft sealing ring. The area located between the radially inner and the outer sealing face is advantageously covered in a sealing manner with the aid of the coupling element. According to a first design variant, for this purpose the coupling element has a collar which accommodates the shaft sealing ring and reaches beyond the section of the casing, preferably at least one second seal, for example an O ring, being provided in order to seal a gap between the collar and the section of the casing. In another design variant of the pump, the coupling element cooperates with an end face of the section of the housing that accommodates the shaft sealing ring, that is to say it does not have a sealing collar but preferably bears with a lateral face facing away from the rotor on the end face of the section of the casing. In order to seal the gap between the coupling element and the end face of the section of the casing, in one advantageous embodiment at least a third seal, for example an O ring, which can be arranged in a groove in the end face, or a sealing disk is provided. In a further design variant, the coupling element engages with its collar in a recess in the section of the casing in which the shaft sealing ring is arranged, it being possible for the gap between the outer circumferential face of the collar and the wall of the recess to be sealed, preferably by means of a third seal.

In a preferred embodiment, there is a clearance connected to the pressure chamber between the coupling element and the pressure plate. On the basis of this configuration, it is possible for the entire projected lateral face, facing the coupling element, of the pressure plate to be acted on by the medium under pressure, for example oil, as a result of which the pressure plate is preferably pressed against a contour ring surrounding the operating chamber. Applying pressure to the entire lateral face of the pressure plate means that deformation of the pressure plate in the manner of a disk spring, which could lead to a short circuit between an inlet zone and a delivery zone of the pump, is prevented. In order to act on the pressure plate with a force oriented in the direction of the rotor, instead of the clearance or in addition to the clearance connected to the pressure chamber, a pressing device can be provided which, for example, comprises at least one disk spring. The pressing device is particularly advantageous when the coupling element is so configured that it cooperates with the end face of the section of the casing that accommodates the shaft sealing ring.

In addition, preference is given to an exemplary embodiment of the pump in which, in the area between the larger-diameter collar and the smaller-diameter section engaging in the through opening in the pressure plate, the coupling element has an annular bead, which is used to stiffen the coupling element. This makes it possible to form the coupling element with a thin wall.

Furthermore, preference is given to an exemplary embodiment of the pump which is distinguished by the fact that the coupling element consists of sheet metal and is preferably formed in one piece. The coupling element formed as a sheet-metal molding can therefore be produced cost-effectively. Of course, the coupling element can be produced from virtually any material which, for example, can be corrosion-resistant and whose strength properties are sufficient to withstand the pressure in the pressure chamber. Since the coupling element is located in the pressure chamber or adjoins the latter, in the case of a vane pump used to deliver oil, the coupling element can also consist of a metal susceptible to rusting, since the coupling element is protected against corrosion by the oil.

Further advantageous embodiments emerge from the other subclaims.

BRIEF DESCRIPTION OF THE DRAWINGS

The invention is explained below with references the drawings, in which.

DESCRIPTION OF PREFERRED EMBODIMENTS

Figure 1:
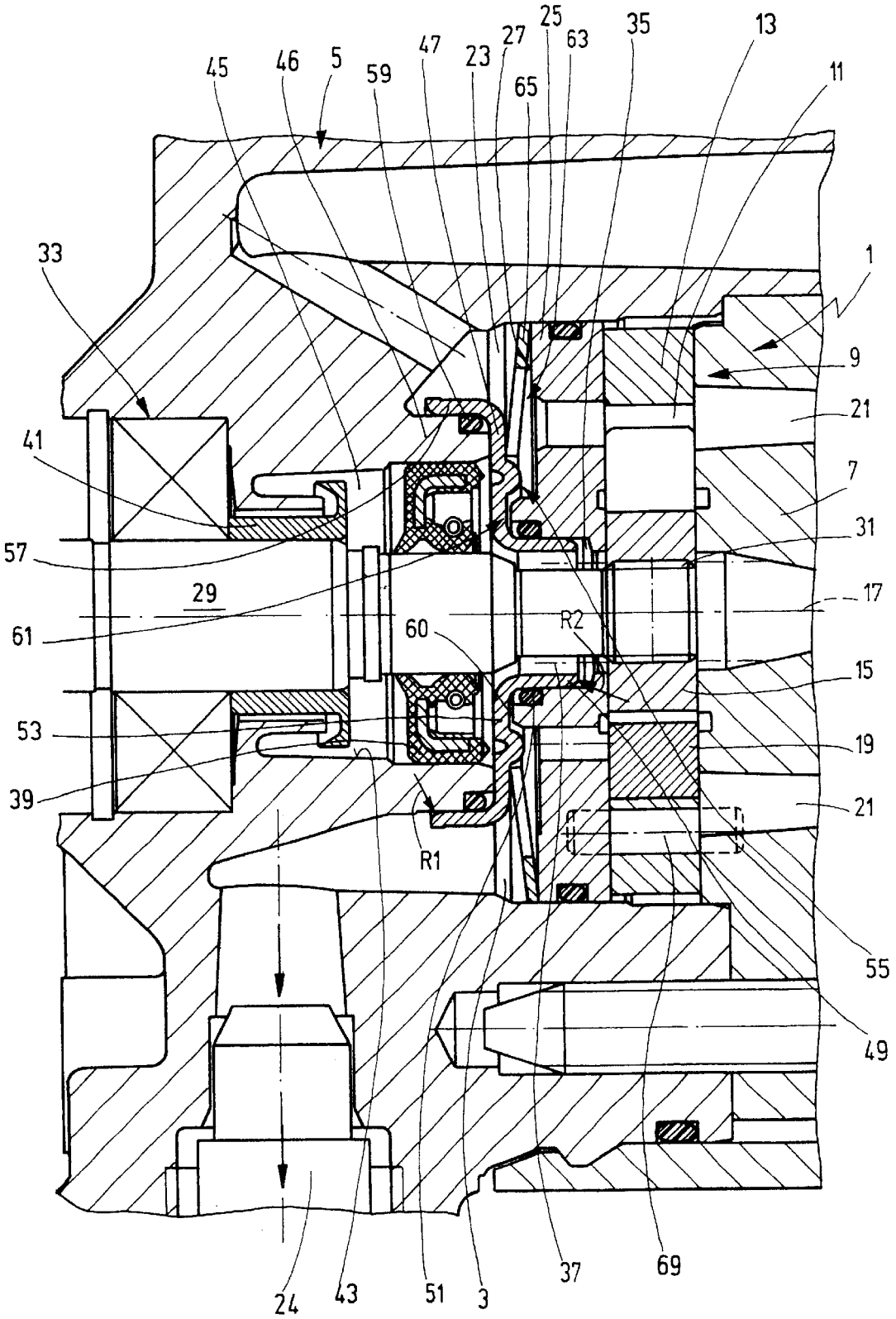
FIG. 1 shows a detail of an exemplary embodiment of a pump with a first embodiment of a coupling element in longitudinal section.

FIG. 1 shows a detail of an exemplary embodiment of a pump 1, which is designed here as a vane pump. The pump I is arranged in the interior 3 of a casing 5 which is closed by a cover 7. The pump 1 comprises a pump unit 9 which comprises a cam ring 13 surrounding a substantially elliptical operating chamber 11 and a rotor 15 arranged in the operating chamber 11, in which rotor slots running radially with respect to a longitudinal mix-axis 17 are made, in which radially displaceable vanes 19 are inserted. Pump chambers which become larger and smaller are enclosed between successive vanes 19, so that during rotation of the rotor 15, during which the vanes 19 follow the inner contour of the cam ring 13, a medium, for example a hydraulic oil, is conveyed from tank connections 21 into a pressure chamber 23. From the pressure chamber 23, the medium passes via a connecting path 24 to a load, as indicated by arrows.

In order to laterally terminate the delivery chambers located between the vanes 19 in the axial direction, a pressure plate 25 is provided on one side of the pump unit 9 and the cover 7 is provided on the other side. These two rest on the lateral faces of the cam ring 13 in a sealing manner and having only a small spacing from the rotor 15 and the vanes 19. On its side face 27 facing away from the rotor 15, the pressure plate 25 is connected to the pressure chamber 23 or, in this exemplary embodiment, is arranged in the pressure chamber 23.

In a different exemplary embodiment, not illustrated in the figures, two pressure plates are provided for the lateral sealing of the delivery chambers located between the vanes 19, said pressure plates bearing on the lateral faces of the cam ring 13, that is to say one of the pressure plates is arranged between the cam ring 13 and the cover 7.

At one end of a drive shaft 29, the rotor 15 is connected to the latter in a rotationally fixed manner with the aid of a splined connection 31. The drive shaft 29 is part of a motor, not illustrated, preferably an electric motor. In order to mount the drive shaft 29, in this exemplary embodiment a bearing 33 arranged in the casing 5 is provided, and here is formed as a rolling-contact bearing. It can be seen that the cantilever-mounted rotor 15 is not provided with its own mounting. This results in a correspondingly large external diameter for the bearing 33.

As FIG. 1 reveals, the drive shaft 29 extends through a through opening 35 in the center of the pressure plate 25. The through opening 35 is formed with a stepped shape, which means that it has a plurality of longitudinal sections of different diameters. The through opening 35 is preferably circular in cross section. The diameter of the through opening 35 in its center area is here substantially as large as the diameter of the drive shaft 29 in the area of the bearing 33. In a different exemplary embodiment, not illustrated in the Figures, the diameter of the through opening 35 is smaller than that of the drive shaft 29 in the area of its longitudinal section arranged in the bearing. The diameter of the longitudinal section of the drive shaft 29 arranged in the through opening 35 is considerably smaller than the diameter of the through opening 35. This results in an annular chamber 37 formed between the circumferential face of the through opening 35 and the external face of the drive shaft 29.

In order to seal off the motor driving the pump 1, in the exemplary embodiment shown in FIG. 1, a shaft sealing ring 39 known per se and a slinger disk 41 arranged in the area between the shaft sealing ring 39 and the bearing 33 and having a sleeve-like base body are provided. The shaft sealing ring 39 is arranged in the area of a section 46 of the casing which extends in the manner of a dome in the direction of the interior 3 of the pump 1. The function of the slinger disk 41 is to guide small quantities of the medium conveyed by the pump 1, which can possibly penetrate through the gaps between the shaft sealing ring 39 and the drive shaft 29 and the shaft sealing ring 39 and the casing 5, radially outward against the wall 43 of a recess 45 that accommodates the slinger disk 41 and the shaft sealing ring 39, where it can be led away in a suitable manner to the outside, for example by means of a relief duct, so that it does not reach the motor.

In order to seal the pressure chamber 23 with respect to the recess 45 containing the shaft sealing ring 39, a coupling element 47 is provided, which is arranged in the area between the pressure plate 25 and the shaft sealing ring 39. Here, the coupling element 47 is formed in one piece and as a sheet-metal molding and has a sleeve-like section 49 which engages in the through opening 35 on the side of the pressure plate 25 facing away from the rotor 15. In order to seal the gap between the section 49 of the coupling element 47 and the wall of the through opening 35, a first seal 51 is provided, which is formed by a round sealing ring here and is arranged in a larger-diameter section of the through opening 35. The sleeve-like section 49 is adjoined by a wall section 53 which runs substantially perpendicular to the section 49 and, on its side facing the pressure plate 25, has an annular bead 55, which is used to stiffen the coupling element 47 which may have a very thin wall. The bead 55 is formed by a channel-like depression on the side facing away from the pressure plate 25. The wall section 53 that extends in the radial direction beyond the recess 45 accommodating the shaft sealing ring 39 is adjoined by a collar 57, which engages over the section 46 of the casing and preferably encloses it completely over its circumference. In order to seal a gap between the collar 57 and the section 46 of the casing, a further, second seal 59 is provided, which is formed here by a round sealing ring, which is arranged on an annular shoulder fitted to the outer side of the section 46 of the casing.

As can be seen from FIG. 1, the distance between the radially inner sealing face between coupling element 49 and the wall of the through opening 35 is considerably smaller than the distance from the radially outer sealing face between the coupling element 47 and the section 46 of the casing. On account of this configuration, a pump 1 or pump unit 9 can be formed whose delivery chambers lying between successive vanes 19 are at only a small distance from the axis of rotation of the drive shaft 29, which means that a compact pump unit 9, in particular one having a small external diameter, can be implemented.

The collar 57 plugged onto the section 46 of the casing has rounding, preferably a radius R1, on the inner side of its free end. The rounding is used to make it easier to plug the collar 57 onto the section 46 of the casing and to avoid damage to the second sealing ring 59. In addition, the section 49 of the coupling element 47 is provided with a rounding, preferably a radius R2, at its free end on the outside. This rounding is intended to make it easier to plug the section 49 into the through opening 35 in the pressure plate 25 and to prevent damage to the first seal 51.

In the area of its vertical wall section 53, the coupling element 47 is formed or so matched to the lateral face 27 of the pressure plate 25 that a substantially annular clearance 61 is formed between coupling element 47 and an annular end wall section 60 of the pressure plate 25, said clearance being connected to the pressure chamber 23 or forming part of the pressure chamber 23.

During the operation of the pump 1, the entire lateral face 27 of the pressure plate 25 and the second seal 59 in the through opening 35 are acted on by the medium under pressure, so that the pressure plate 25 is pressed against the cam ring 13. At the same time, the coupling element 47 is pressed with the lateral face of its radial wall section 53 against the end of the section 46 of the casing.

In the exemplary embodiment illustrated in FIG. 1, a pressing device 63 is arranged in the pressure chamber 23 and has a compression spring 65, which is supported on the casing 5 via the coupling element 47 and acts on the pressure plate 25, on its lateral face 27, with a force oriented in the direction of the axis of rotation of the drive shaft 29. During the operation of the pump 1, the pressing device 63 assists the action of pressing the pressure plate 25 against the cam ring 13. In the unpressurized state, the pressure plate 25 is pressed against the cam ring 13 only by the pressing device 63, so that lateral sealing of the delivery chambers between the vanes 19 is provided even before the pump 1 is started up.

The motor, not illustrated in the figures, and the pump 1 in the exemplary embodiment illustrated in FIG. 1 form a unit when assembled, which is also the subject of the invention, the assembly of the slinger disk 41 and in particular of the shaft sealing ring 39 being carried out only after the motor has been installed from the pump side. In the exemplary embodiment shown in FIG. 1, the bearing 33 for the drive shaft 29 is introduced into the casing 5 from the motor side.

In another exemplary. embodiment, not illustrated in the figures, provision is made for the bearing 33 for the drive shaft 29 also to be capable of being assembled from the pump side, just like the shaft sealing ring 29, which is associated with advantages during assembly and the coupling of the pump and of the motor to each other. In this embodiment, in particular the shaft sealing ring 39 has a very large external diameter. However, since the coupling element 47 is arranged between the pressure chamber 23 of the pump 1 and the motor, the radially inner sealing face of the pressure chamber can nevertheless be arranged very close to the point at which the drive shaft 29 passes through the pressure plate 25, so that a smaller external diameter of the pressure plate 25 can be implemented.

Figure 2:
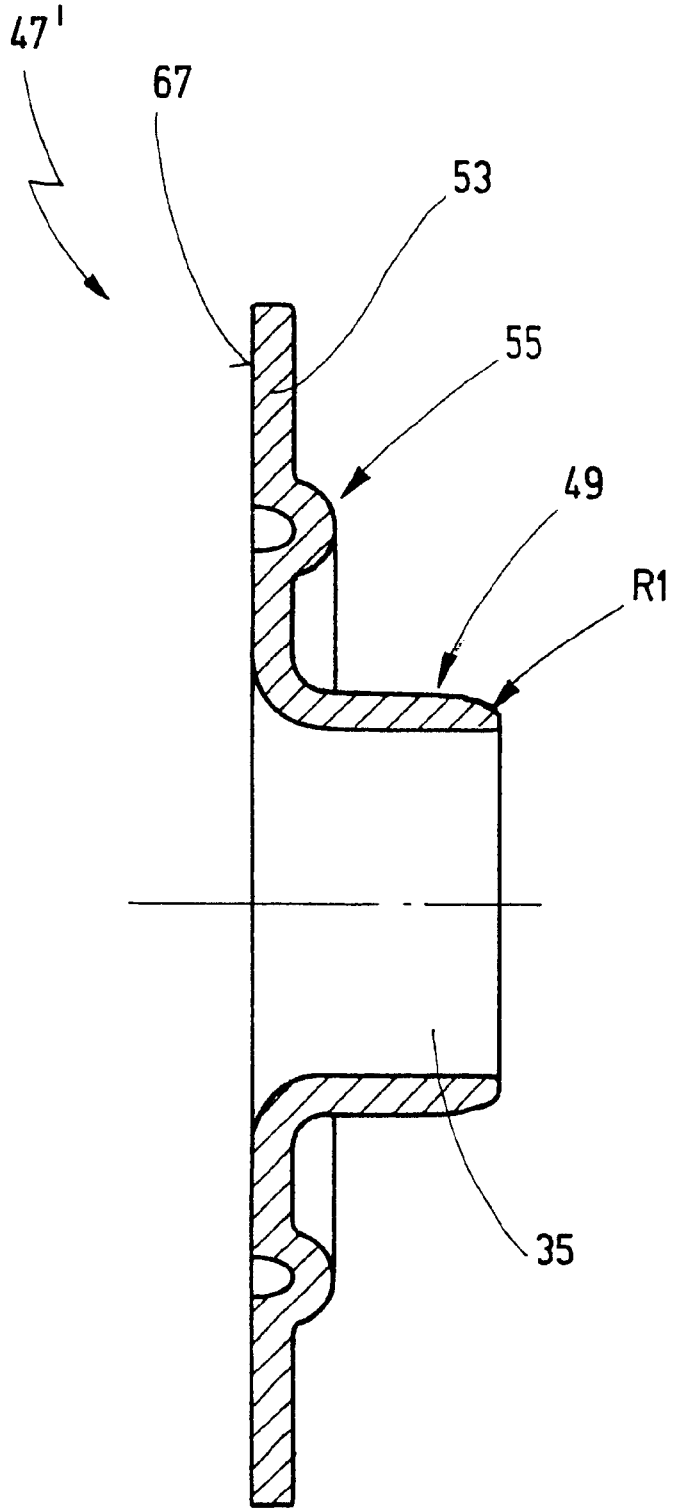
FIG. 2 shows a longitudinal section of a second embodiment of the coupling element.

FIG. 2 shows a second exemplary embodiment of the coupling element 47', identical parts being provided with identical reference symbols, so that to this extent reference is made to the description relating to FIG. 1.

The coupling element 47' differs from the coupling element 47 shown in FIG. 1 only in the fact that it does not have a collar 57. In the assembled state, the wall section 53 of the coupling element 47' is pressed with its lateral face 67 facing away from the motor against the end of the section 46 of the casing. The radially outer sealing face of the pressure chamber 23 is therefore no longer located on the outside of the section 46 of the casing and therefore closer to the drive shaft 29. In order to seal the gap between the lateral face 67 of the wall section 53 of the coupling element 47and the end of the section 46 of the casing, a third sea' is provided in an advantageous exemplary embodiment. The coupling element 47', which can be produced more simply as compared with the coupling element 47 shown in FIG. 1, is pressed continuously in a sealing manner against the end of the section 46 of the casing, with the aid of the pressing device 63. Of course, it may also be possible, with the aid of the medium under pressure in the pressure chamber 23, to ensure adequate pressing of the coupling element 47' against the section 46 of the casing, even when there is a low pressure in the pressure chamber 23, in order to ensure sealing, so that it may be possible to dispense with the pressing device 63. Furthermore, it is possible for the pressing forces to be applied by the seals.

The fact that the coupling element 47' illustrated in FIG. 2 covers only the mouth of the recess 45 in the casing 5 means that the risk of double centering of the pressure plate 25, which is already centered by means of pins arranged in the pressure plate 25, the cam ring 13 and the cover 7, of which one pin 69 is illustrated in FIG. 1, can virtually be ruled out.

The coupling element 47, 47' can consist of metal or plastic and is preferably formed in one piece. In a preferred embodiment, the coupling element 47, 47'—as illustrated in FIGS. 1 and 2—is designed symmetrically with respect to the axis.

On account of the space-saving design of the pump 1, in particular because of the small external diameter of the pump unit 9, which is only possible through the coupling element 47 or 47', the use of the pump 1 driven by the motor, preferably electric motor, is particularly advantageous in a motor vehicle, in which there is only little space available and a low weight is required.

The advantages of the coupling element 47 and 47', respectively, as described in FIGS. 1 and 2, naturally result even when the pump 1 is designed as a rolling cellular pump, blocking vane pump or the like.

The patent claims filed with the application are proposed formulations without prejudice for the achievement of more extensive patent protection. The applicant reserves the right to claim still further features, as yet disclosed only in the description and/or drawing.

Back references used in subclaims point to the further development of the subject of the main claim by means of the features of the respective subclaim; they are not to be understood as dispensing with the achievement of independent, concrete protection for the features of the subclaims making such back references. However, the subjects of these subclaims also form independent inventions, which have a structure independent of the subjects of the preceding subclaims.

Nor is the invention restricted to the exemplary embodiments of the description. Instead, within the scope of the invention, numerous amendments and modifications, in particular those variants, elements and combinations and/or materials which are inventive, for example as the result of combination or modification of individual features or elements or method steps with those described in the general description and embodiments and in the claims and contained in the drawings and, by means of features which can be combined, lead to a new subject or to new method steps or sequences of method steps, including those which to this extent relate to the production, testing and working methods.

We claim:

1. A vane pump for pumping a liquid or gaseous medium, the pump comprising:

a casing, an operating chamber in the casing, the operating chamber having opposite first and second axial sides;

a rotatable rotor in the casing, a drive shaft connected with the rotor for rotating the rotor;

pump vanes in the operating chamber and the vanes being attached to the rotor to rotate with the rotor; the vanes being radially moveable in the operating chamber of the pump as the rotor rotates;

a pressure plate positioned at the first axial side of the operating chamber, the pressure plate having an axially inward lateral face toward the operating chamber for closing the operating chamber at the first axial side; the pressure plate having an axially outward lateral face facing away from the operating chamber and away from the rotor in the operating chamber; a through opening in the pressure plate through which the drive shaft extends;

the casing including a pressure chamber communicating with the axially outward lateral face of the pressure plate; a pump connection from an external source of a medium past the operating chamber and the vanes and to the pressure chamber, whereby the pressure chamber is supplied with medium under pressure by rotation of the rotor and operation of the vanes;

a coupling element including a first portion thereof which surrounds a portion of the drive shaft axially at the pressure chamber; a shaft seal around the drive shaft, axially outward of the pressure plate and the coupling element and the shaft seal being shaped and positioned to seal the pressure chamber with respect to the drive shaft;

the coupling element having a first sleeve section which extends into the through opening in the pressure plate and engages the pressure plate in the through opening in the pressure plate;

said shaft seal comprising a shaft seal ring around the shaft, the shaft seal ring having a radial exterior of an external diameter and having a radial interior engaging the shaft; the shaft seal ring is axially outward of the pressure plate; the diameter of the through opening in the pressure plate is smaller than the external diameter of the shaft seal ring;

the casing having a section shaped for engaging and which accommodates the radial exterior of the shaft seal ring; and the coupling element including a second collar that engages at least partially over the section of the casing which accommodates the shaft seal ring.

2. The pump of claim 1, further comprising a seal positioned for sealing off any gap between the collar and the section of the housing to be engaged by the collar.

3. The pump of claim 1, further comprising a pressing device pressing on the pressure plate in the direction toward the rotor.

4. The pump of claim 1, wherein the coupling element is comprised of sheet metal in one piece.

5. The pump of claim 1, further comprising a first seal positioned for sealing any gap between the sleeve section of the coupling element and the through opening of the pressure plate.

6. The pump of claim 5, further comprising a seal positioned for sealing off any gap between the collar and the section of the housing to be engaged by the collar.

7. The pump of claim 1, wherein the casing includes a casing section which surrounds and accommodates the shaft seal ring, the casing section has a lateral face which faces axially toward the rotor; the coupling element being shaped to cooperate with the lateral face of the casing section.

8. The pump of claim 7, wherein the coupling element includes the sleeve section at the pressure plate and further includes a wall section running substantially perpendicular to the sleeve section engaging the lateral face of the casing section.

9. The pump of claim 8, further comprising an annular bead formed in the wall section of the coupling element.

10. The pump of claim 8, wherein the coupling element is comprised of sheet metal in one piece.

11. The pump of claim 7, wherein the coupling element is generally S-shaped including the sleeve section as one leg of the S, the portion of the coupling element engaging the lateral face of the section comprising the mid-section of the S and a portion of the coupling element engaging the casing and extending generally in the direction of the shaft and comprising the other leg of the S.

12. The pump of claim 11, further comprising a respective seal between the one leg of the coupling element in the pressure chamber and a second seal between the other leg of the coupling element and the casing.

13. The pump of claim 1, wherein the coupling element and the pressure plate are respectively so shaped as to define a clearance there connected to the pressure chamber.

14. The pump of claim 13, further comprising a seal between the coupling element and the pressure plate and the seal being positioned for sealing the clearance in the direction toward the rotor.

* * * * *

UNITED STATES PATENT AND TRADEMARK OFFICE

CERTIFICATE OF CORRECTION

PATENT NO. : 6,641,380 B1 
DATED : November 4, 2003
INVENTOR(S) : Thomas Nied-Menninger et al.

It is certified that error appears in the above-identified patent and that said Letters Patent is hereby corrected as shown below:

Title page,
Item [73], change the Assignee to -- Luk Fahrzeug-Hydraulik GmbH & Co. KG (DE) --.

Signed and Sealed this

Ninth Day of March, 2004

JON W. DUDAS
*Acting Director of the United States Patent and Trademark Office*